US006112360A

United States Patent [19]

Kalm et al.

[11] Patent Number: 6,112,360

[45] Date of Patent: Sep. 5, 2000

[54] FLEXIBLE VEHICLE BUMPER PROTECTOR MAT FOR GOLF SPIKES

[76] Inventors: W. Scott Kalm, 6328 Courtland Dr., Plano, Tex. 75093; Keith C. Kalm, 508 Richmond Dr., #5, Millbrae, Calif. 94030

[21] Appl. No.: 09/151,038

[22] Filed: Sep. 10, 1998

[51] Int. Cl.[7] ..... A46B 15/00

[52] U.S. Cl. ..... 15/161; 15/217; 15/238; 15/246

[58] Field of Search ..... 15/161, 215, 216, 15/217, 237, 238, 239, 240, 241, 246; 296/136, 39.1; 248/633; 473/278, 162; 206/315.5; 224/563, 572, 918, 919, 901.4, 901.8, 932

[56] References Cited

U.S. PATENT DOCUMENTS 3,902,752 9/1975 Pelletier .

5,075,917 12/1991 Wheat et al. .

5,273,316 12/1993 Infante .

*Primary Examiner*—Terrence R. Till

*Assistant Examiner*—Jennifer McNeil

*Attorney, Agent, or Firm*—Jenkens & Gilchrist, P.C.

[57] ABSTRACT

A vehicle bumper protector for golf spikes is disclosed and includes a thin flexible rubber strip that drapes over the rear bumper of a vehicle upon which a golf shoe may be placed. The protector is attached to the interior of the vehicle trunk by means of a VELCRO® brand fastener, snaps, or the like for easy, one-step installation and removal. The protector may also include one or more of the following: (1) a golf shoe spike cleaner composed of a brush; (2) a detachable golf accessory bag for holding golf tees, balls, ball markers, and the like; and (3) two pairs of elastic straps on opposite sides of the protector for restraining the golfer's shoes when not in use with the spikes in a protected position. The device adapts readily, without any adjustments, to any vehicle with a trunk or rear door and rear bumper at step height.

10 Claims, 5 Drawing Sheets

FLEXIBLE VEHICLE BUMPER PROTECTOR MAT FOR GOLF SPIKES

BACKGROUND OF THE INVENTION

1. Technical Field of the Invention

The present invention relates to the protection of vehicle rear bumpers from damage or scratch marks created by contact with golf shoe spikes.

2. Description of Related Art

With the ever increasing popularity of the game of golf, it has become apparent that current solutions dedicated to providing golfers with a mechanism to change from street shoes to golf shoes at the golf course are inadequate. Golf shoes generally have a plurality of thin, metal spikes or hard plastic (▒soft▒) spikes mounted on the underside sole. Since few golfers arrive at a golf course with their golf shoes already on, there exists a need for a place to comfortably change shoes such that the golfer's street shoes may be left in their vehicle. Until now, a golfer's options were limited. A golfer could sit in the vehicle with the door ajar, place the golf shoes on the ground, and then bend over to insert a foot into the shoe and tie the laces. In the alternative, a golfer may stand upright outside the vehicle, either bending all of the way to the ground to insert a foot into the shoe and tie the laces or lifting one foot in the air to do the same. Both of these methods are awkward for the majority of golfers and uncomfortable for golfers who are either of an advanced age or have a bad back. Placing the golf shoes on a raised surface in order to tie the laces is a viable alternative, but the only convenient raised surface in a parking lot is typically a surface of the golfer's vehicle. Placing abrasive golf spikes on a vehicle surface, however, in most cases will leave unwanted scratch marks in the vehicle's finish (such as paint, chrome, or other composite).

A wide variety of steps and supports have been developed for use with vehicles in the past, including an inverted U-shaped mechanical device with an attached footrest designed to allow a golfer to place a foot on the footrest which is mounted at the bumper height of the vehicle as shown in U.S. Pat. No. 5,620,059. As with the steps and supports designed for vehicles in the past, this design is complicated and cumbersome to install and store. While this design may purportedly be adjusted for use in multiple vehicles, such adjustments require time, tools, and some mechanical knowhow. Further, the installation and removal of this device over the trunk wall for each use leaves in place the potential for scratching the vehicle's surface, this raising the very problem sought to be resolved.

There have been other attempts to protect numerous surfaces (from putting greens to sidewalks), as well as the golf spikes themselves, from the wear and tear that contact between the spikes and either hard or soft surfaces creates. These inventions are embodied primarily in shields or guards designed to attach to the bottom of the golf shoe over the spikes. Various devices are shown in U.S. Pat. Nos. D 385,092, 3,574,959, 5,070,631, 5,548,910, and 5,600,902. There are several disadvantages to these solutions, including: (1) the shields/guards may need to be replaced due to wear caused by contact with hard surfaces when walking or contact with the sharp spikes; (2) the shields/guards may need to be replaced with each new design of golf shoe; and (3) the shields/guards need to be stored between uses and since they are detachable, are subject to being easily misplaced.

Another difficulty associated with golf shoe spikes is that they occasionally become encased in turf, mud, or other debris. A variety of cleaning devices have been developed to clean golf and other sport shoes. These devices range from simple, hand-held brushes and scraping tools, as shown in U.S. Pat. Nos. 3,789,453, D 259,372, 4,670,932, D 293,164, D 334,843, D 356,892, 4,785,490, 5,509,167, and 5,694,660, to a canister containing cleaning fluid and a brush, which can be attached to a golf bag or cart, as demonstrated in U.S. Pat. No. 4,945,596.

In addition, cleaning devices have been invented which resemble a golf club, having a brush where the club head is normally located as shown in U.S. Pat. Nos. 4,571,767 and D 256,524. These devices are utilized by holding the handle in one hand, placing the brush on the ground and stabilizing the device by depressing a cleat on the bottom of the brush into the ground and then running the bottom of the golf shoe over the brush. A similar, but simpler device is demonstrated by U.S. Pat. No. 5,077,858—a mat with bristles on top and spikes on the bottom to allow it to be anchored to the ground such that golf shoe cleats may be cleaned by running them across the bristles.

Other inventions have taken the basic brush or scraping device and mounted it to various devices for purposes of transport or stability, including: at the base of a golf bag (U.S. Pat. No. 5,479,674); under the door of a car or truck (U.S. Pat. No. 3,740,072); on the side of a golf cart (U.S. Pat. No. D 318,826); and to the wheel of a golf cart (U.S. Pat. No. 3,747,150).

There are several drawbacks associated with each of the above designs, including: (1) any permanently mounted device detracts from the aesthetic appeal of the device to which it is attached and requires the user to attempt to clean the debris from the attached device in whatever position it is mounted, (2) the above devices are designed for use while the golf shoe is on the golfer's foot, and (3) any device which is not mounted, but is intended to be carried around, is subject to being misplaced.

There is a need in the art for providing golfers with an inexpensive, lightweight, unobtrusive, and easy-to-use alternative for protecting their vehicle bumper from golf shoe spike scratches. There is a further need in the art for providing golfers with a mechanism to clean their golf shoe spikes at their vehicle bumper.

SUMMARY OF THE INVENTION

A vehicle bumper protector for golf shoe spikes comprises a thin, resilient but flexible rubber strip that is easily attached to or detached from the inner surface of the trunk or rear interior of a vehicle by means of a VELCRO® brand fastener, snaps, holes through which a tie down rope may be strung, or the like. Once attached, the flexible protector drapes over the edge of the bumper, to provide a protective covering for the bumper while allowing a golf shoe to be safely placed thereon. The vehicle bumper protector also comprises a brush for cleaning golf shoe spikes mounted to or integrated into the rubber strip on the end opposite the fastening device. In addition, the vehicle bumper protector comprises a detachable golf accessory bag for holding golf tees, balls, ball markers, and the like. Finally, the vehicle bumper protector comprises a mechanism for storage of golf shoes when not in use such that the golfer's shoes, accessories, and vehicle bumper protector may be kept together in one place.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 1:
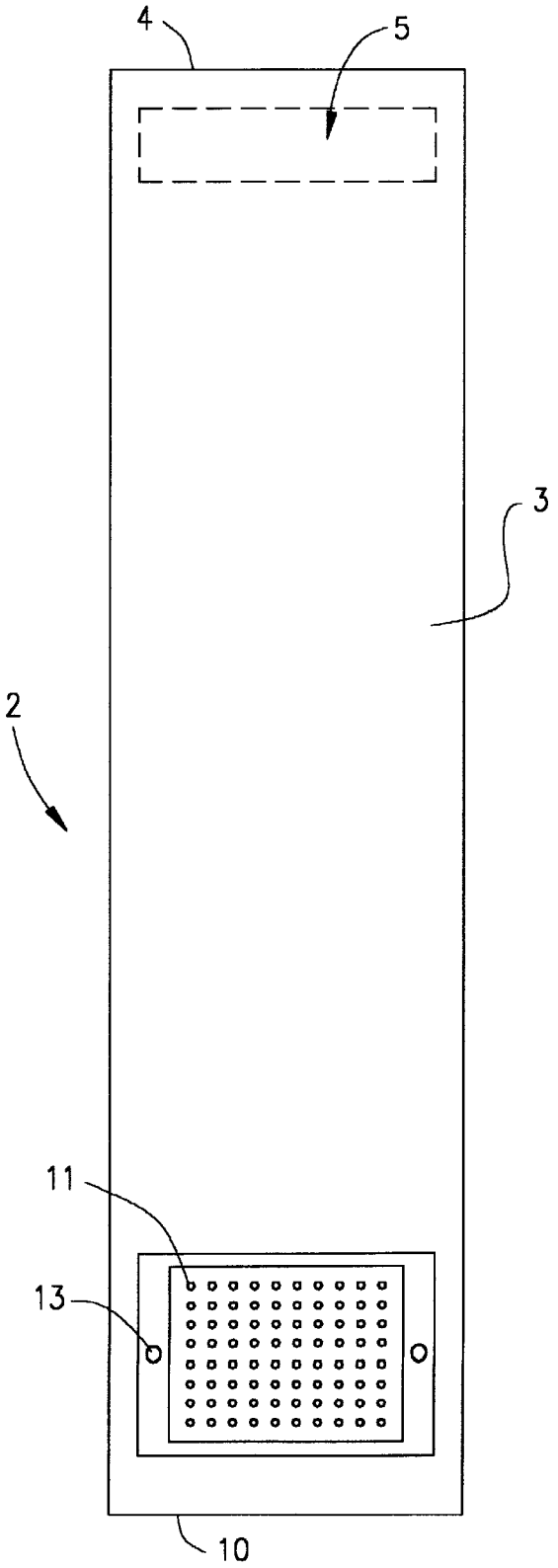
FIG. 1 is a top view of a vehicle bumper protector with the brush and VELCRO® brand fastener for attachment.
Figure 3:
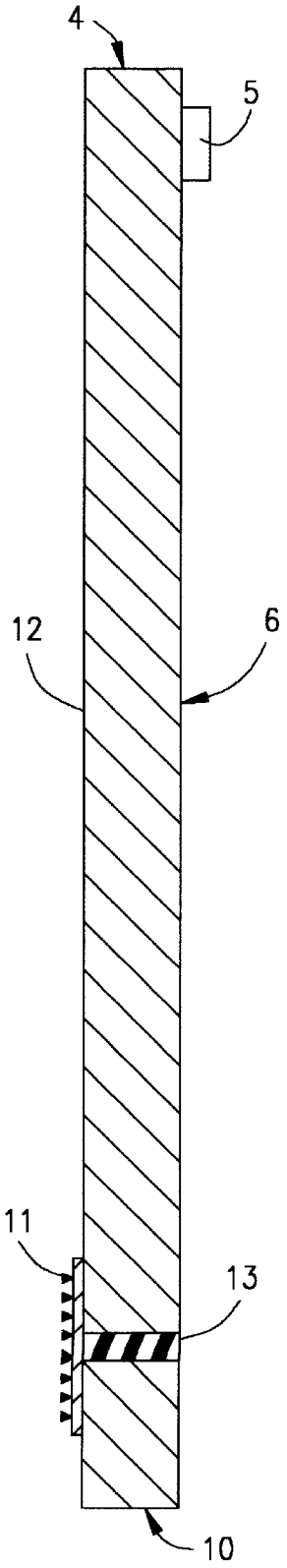
FIG. 3 is a side, cross-sectional view of the vehicle bumper protector shown in FIG. 1.
Figure 2:
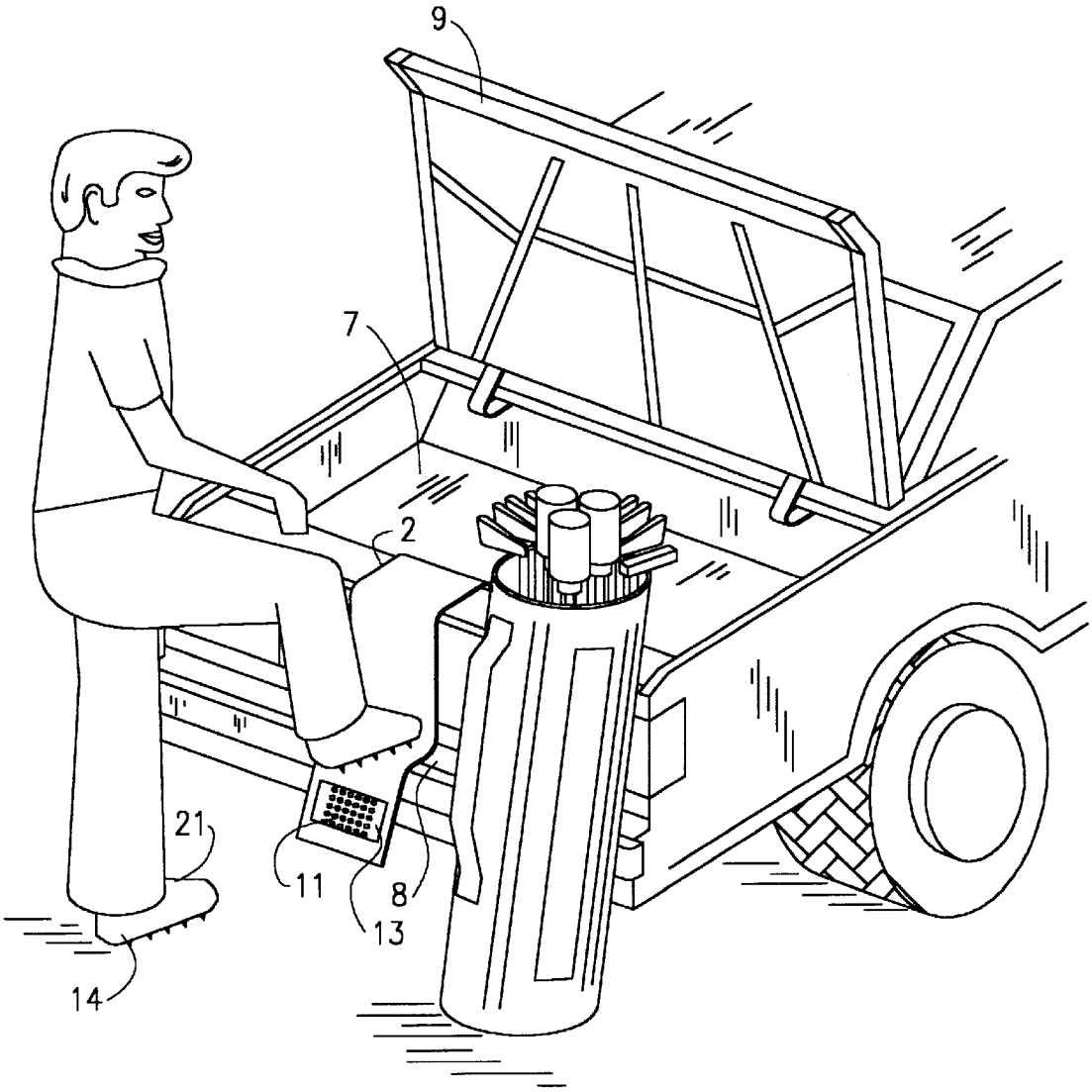
FIG. 2 is a perspective view of a golfer using the vehicle bumper protector of FIG. 1 when installed on a vehicle trunk wall.
Figure 4:
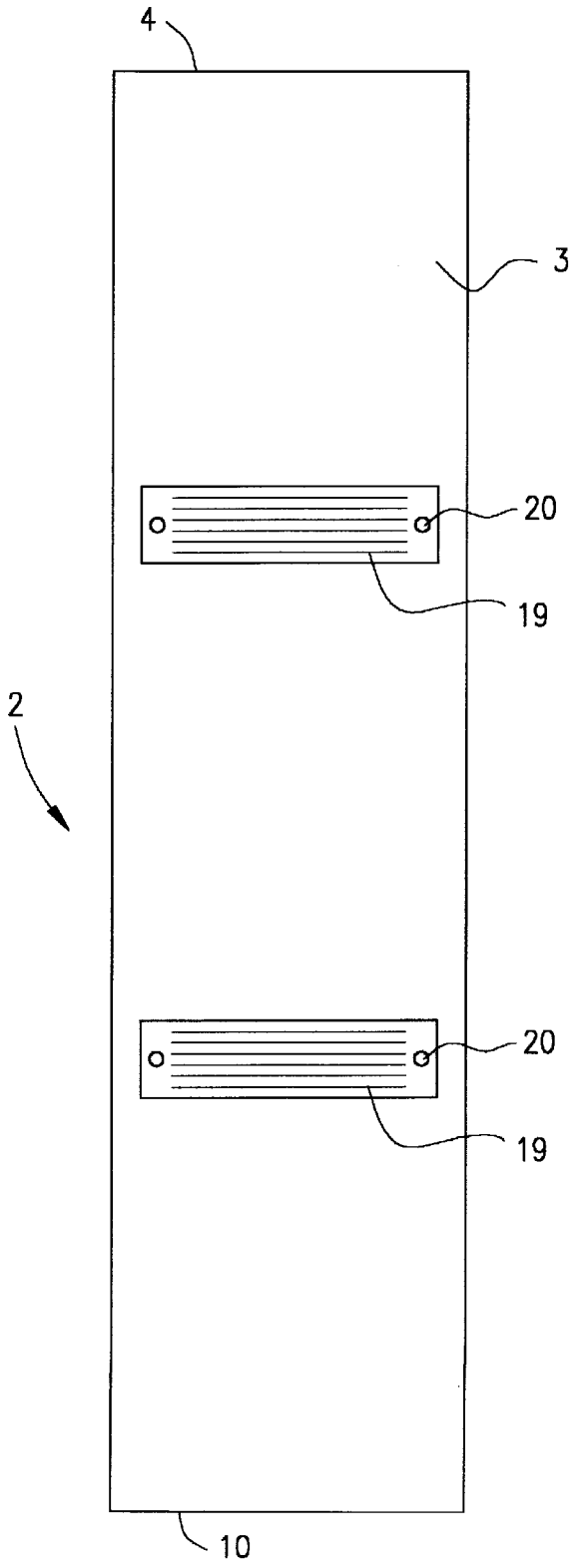
FIG. 4 is a top view of a vehicle bumper protector with the elastic straps for restraining golf shoes.
Figure 5:
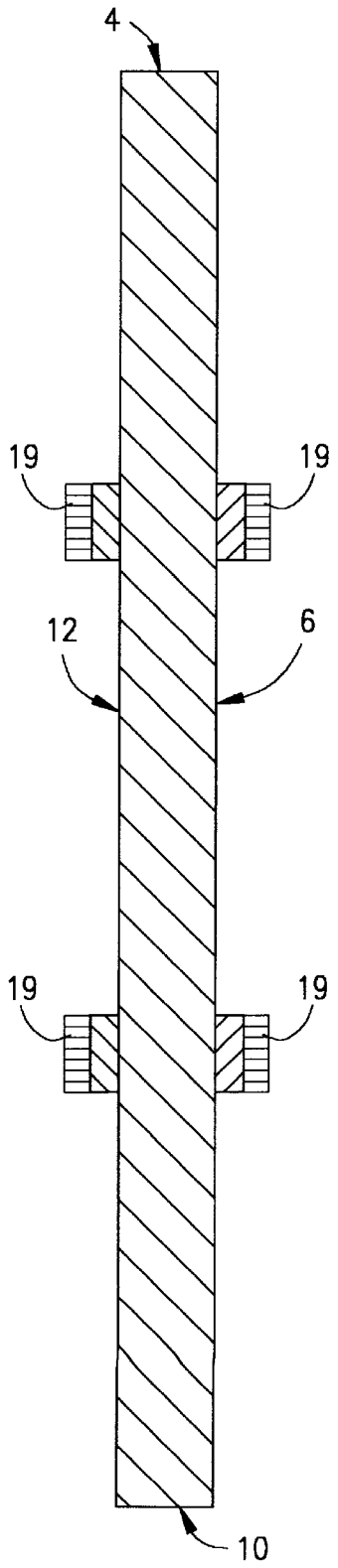
FIG. 5 is a side, cross-sectional view of the vehicle bumper protector shown in FIG. 4.
Figure 6:
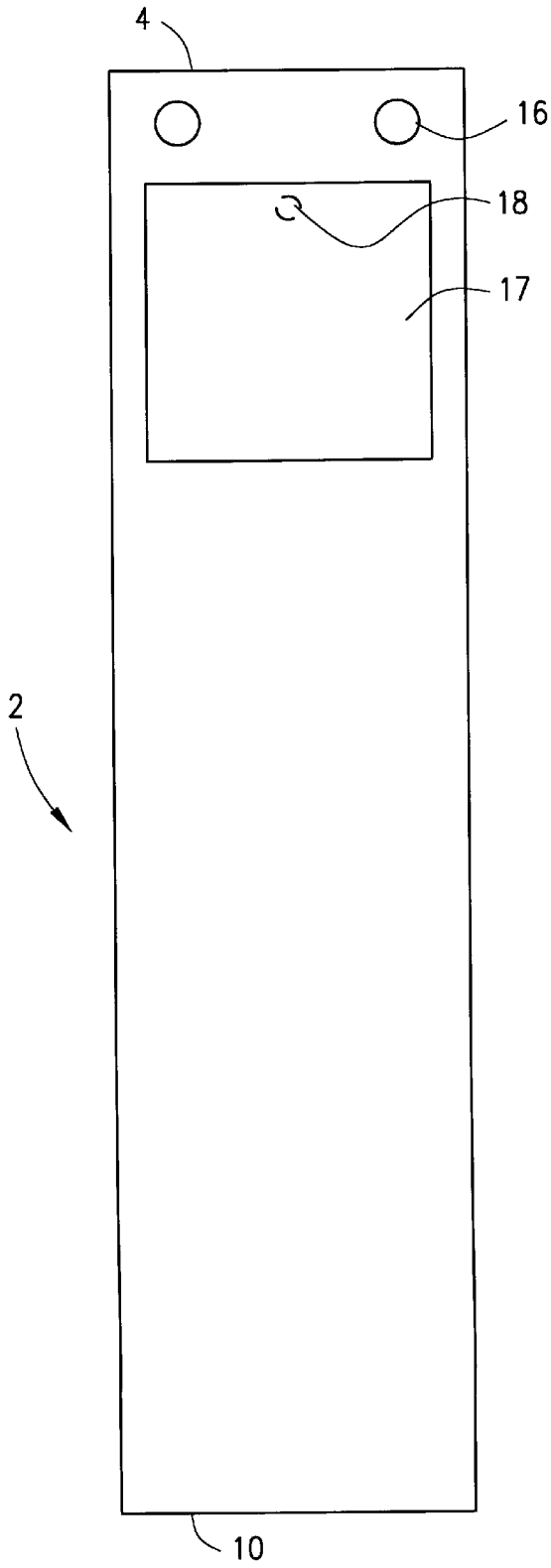
FIG. 6 is a top view of a vehicle bumper protector with the golf accessory bag and holes for attachment.
Figure 7:
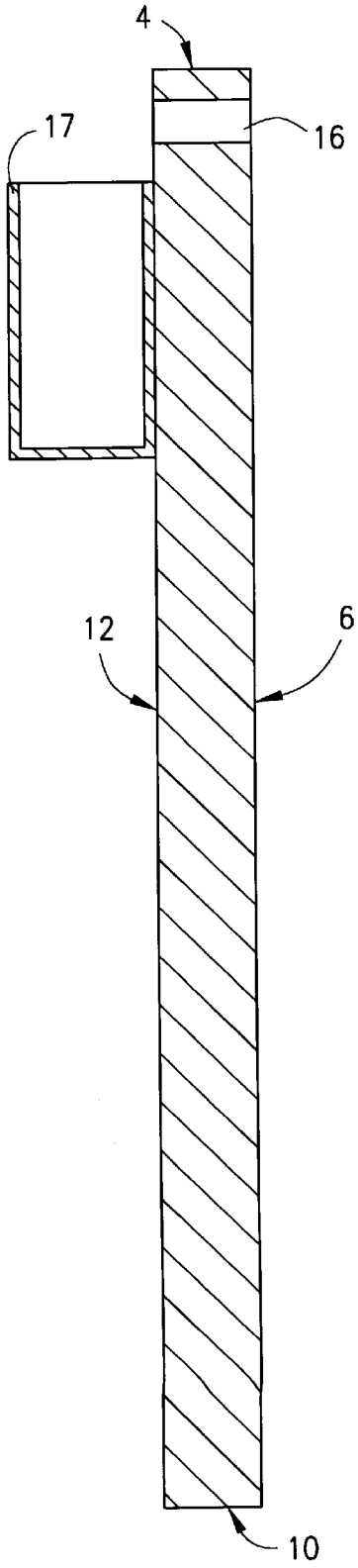
FIG. 7 is a side, cross-sectional view of the vehicle bumper protector shown in FIG. 6.
Figure 8:
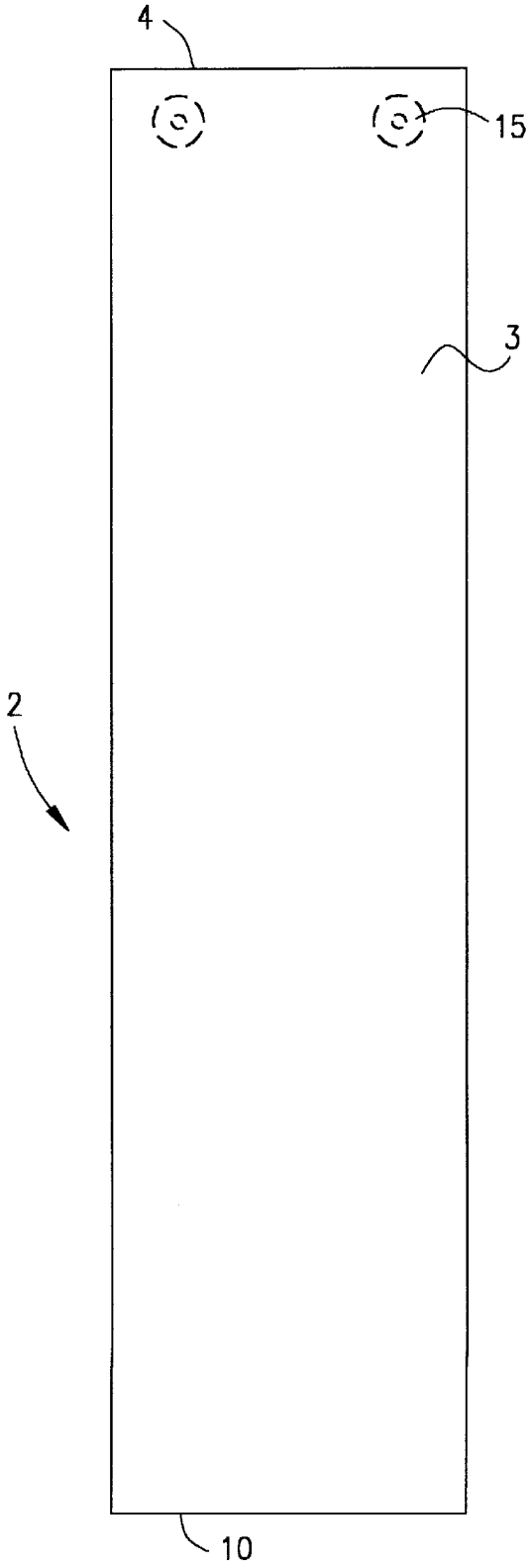
FIG. 8 is a top view of a vehicle bumper protector with snap mechanisms for attachment.
Figure 9:
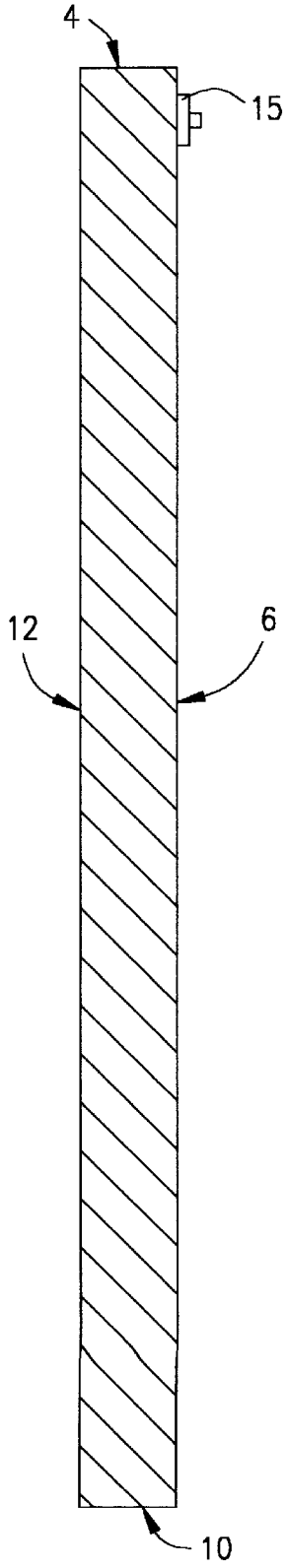
FIG. 9 is a side, cross-sectional view of the vehicle bumper protector shown in FIG. 8.

A flexible vehicle bumper protector mat 2 in accordance with the present invention is shown in FIGS. 19. The bumper protector mat 2 comprises a thin, resilient but flexible strip 3. The strip 3 is preferably made of rubber (such as duro 60 neoprene) or some other flexible material that is resistant to scarring, tearing, and puncture. The mat 2 preferably has a thickness to protect against puncture, a width that is greater than the width of a standard golf shoe, and a length long enough to extend out from a vehicle's trunk 7 and drape completely over a horizontal surface of a vehicle bumper 8. At one end 4 of the strip 3, a VELCRO® brand fastener 5 or other attachment means (such as snaps 15 or holes 16 through which a string may be woven) is provided to allow the unit to be secured within a vehicle. The fastener 5 and snaps 15 are mounted to an underside surface 6 of the mat 2. Using this fastener 5 (15 or 16), the mat may 2 be installed within and attached to an interior surface of an automobile trunk 7.

When in use, the bumper protector mat 2 extends out from the trunk 7 and drapes over the rear bumper 8 of the vehicle. When in this position, the mat 2 provides a protective surface cover for the horizontal part of the bumper 8, allowing golf shoe spikes 14 to be placed thereon without causing damage. When not in use, the mat 2 may be rolled up or folded away and easily stowed within the trunk 7 allowing the trunk lid 9 to be closed.

At another end 10 of the strip 3, a brush 11 for cleaning golf shoe spikes 14 is mounted to a topside 12 surface of the other end 10 of the mat 2. The brush 11 is mounted by mechanical fasteners 13, preferably composed of a plastic material, on either side of the brush 11. Alternatively, the brush may be integrally formed in the rubber material of the mat 2. On the topside surface 12 of the end 4 of the strip 3 nearest the fastener 5 (15 or 16), a golf accessory bag 17 (for storing golfing accessories such as balls, tees, markers and the like) is attached by means of a snap 18. The bag 17 may be made of a synthetic woven cloth, or alternatively may be made of rubber like the mat 2.

On both the topside surface 12 and underside surface 6 of the mat 2, a pair of elastic straps 19 are attached at the mat edges by snaps, integral fabrication or other mounting mechanism 20. The straps are oriented to span the width of the strip 3 at a distance apart from each other sufficient to restrain an adult golf shoe 21. One of the straps may be used to restrain the toe portion of the shoe while the other strap may be used to restrain the heal portion of the shoe. The elastic straps 19 preferably should be located near to the end 10 of the mat 2 close to the brush 11.

Among its many advantages, the present invention adapts to any vehicle, including the increasingly popular sport utility vehicles and minivans which do not have trunks but do have bumpers, without complicated adjustments to the provided mechanical fasteners. There is also minimal danger of the present invention itself scratching the vehicle's finish during use, installation or removal. In addition to the primary function of protecting a vehicle's rear bumper, the present invention also provides a means to clean the golf shoe spikes before placing the golf shoe in a golfer's bag, trunk, or vehicle interior after use. The advantages of this brush design over previous configurations include: (1) it is readily available while the golfer is changing to or from golf shoes; (2) the mat may be removed from the vehicle and held in one hand while the shoe is held in the other to allow the golfer to clean the shoe other than when it is still on their foot, making it easier for the golfer to see whether the shoe is coming clean without constantly bending over to check their progress; and (3) the entire protective mat can be easily removed such that any debris from cleaning the spikes may be dislodged from the brush before the mat is placed either flat or rolled or folded up back in the trunk or interior of the vehicle.

An additional advantage of the present inventors is the presence of a detachable golf accessory bag for storage of golf tees, balls, ball markers, and the like. Using the bag, these items may be conveniently kept with the vehicle bumper protector and be available when a golfer is ready to play. Another advantage is the ability for a golfer to securely store their golf shoes using the straps of the vehicle bumper protector with the spikes resting against either side of the mat such that the spikes will not be free to scratch surrounding items in the vehicle's trunk or interior.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A vehicle bumper protector mat for golf spikes adapted to protectively cover a vehicle's rear bumper by draping over the edge of a vehicle's trunk, said protector comprising:

a flexible strip of material sized in width to accommodate the resting placement of at least one golf shoe and sized in length to extend out from the vehicle's trunk and drape over the vehicle's rear bumper to provide a surface support for resting placement of the golf shoe, means for releasably attaching said strip to an interior surface of the vehicle's trunk, and a detachable golf accessory bag attached on one side of the strip.

2. The vehicle bumper protector as set forth in claim 1, wherein said material is rubber.

3. The vehicle bumper protector as set forth in claim 1, wherein said means of releasably attaching is a hook and loop type fastener.

4. The vehicle bumper protector as set forth in claim 1, wherein said means of releasably attaching is a snap.

5. The vehicle bumper protector as set forth in claim 1, wherein said means of releasably attaching is a hole for tying the strip down.

6. A vehicle bumper protector mat for golf spikes adapted to protectively cover a vehicle's rear bumper by draping over the edge of a vehicle's trunk, said protector comprising:

a flexible strip of material sized in width to accommodate the resting placement of at least one golf shoe and sized in length to extend out from the vehicle's trunk and drape over the vehicle's rear bumper to provide a surface support for resting placement of the golf shoe, means for releasably attaching said strip to an interior surface of the vehicle's trunk, and a set of elastic straps extending across the width of the strip on either side of the strip for restraining a pair of golf shoes with spikes facing the protector sides.

7. The vehicle bumper protector as set forth in claim 6, wherein said material is rubber.

8. The vehicle bumper protector as set forth in claim 6, wherein said means of releasably attaching is a hook and loop type fastener.

9. The vehicle bumper protector as set forth in claim 6, wherein said means of releasably attaching is a snap.

10. The vehicle bumper protector as set forth in claim 6, wherein said means of releasably attaching is a hole for tying the strip down.

* * * * *